United States Patent [19]

Gerlack

[11] Patent Number: 4,740,764

[45] Date of Patent: Apr. 26, 1988

[54] PRESSURE SEALED WAVEGUIDE TO COAXIAL LINE CONNECTION

[75] Inventor: Richard Z. Gerlack, Cupertino, Calif.

[73] Assignee: Varian Associates, Inc., Palo Alto, Calif.

[21] Appl. No.: 57,550

[22] Filed: Jun. 3, 1987

[51] Int. Cl.[4] ..... H01P 5/103

[52] U.S. Cl. ..... 333/26; 333/252; 333/99 R

[58] Field of Search ..... 333/21 R, 26, 230, 245, 333/248, 252, 99 R

[56] References Cited

U.S. PATENT DOCUMENTS 2,442,118 5/1948 Donal, Jr. et al. .

2,527,146 10/1950 Mumford .

3,086,181 4/1963 Lind .

3,605,041 9/1971 Judkins .

3,753,031 8/1973 Aucouturier et al. .

4,349,790 9/1982 Landry ..... 333/26 X

*Primary Examiner*—Paul Gensler

*Attorney, Agent, or Firm*—Stanley Z. Cole; John C. Yakes; Peter J. Sgarbossa

[57] ABSTRACT

A pressure sealed waveguide to coaxial line connection formed with a low cost, non-pressurizable waveguide to coaxial line adapter, an elastomeric sealing boot, and a specially configured mounting seat on a housing which contains a pressurizable waveguide cavity. The connection provides a low cost alternative to hermetically sealed waveguide to coaxial line adapters.

3 Claims, 1 Drawing Sheet

PRESSURE SEALED WAVEGUIDE TO COAXIAL LINE CONNECTION

BACKGROUND OF THE INVENTION

I. Field of the Invention

This invention relates generally to microwave transmission apparatus and more particularly to apparatus used to transition from coaxial transmission lines to waveguides. In many applications it is desirable to maintain a positive gas pressure in the waveguide. The present invention is directed toward such applications.

II. Description of the Prior Art

Microwave systems are frequently designed to employ pressurized waveguides which function to keep the system clean and dry thereby avoiding problems associated with contaminants and moisture condensation. Additionally, waveguide pressurization can function to increase the power carrying capability of the waveguide. Pressurized waveguide to coaxial line transitions are commonly used on the secondary arms of waveguide couplers which monitor power in a system. When confronted with the design requirement for a pressurized transition, workers in the prior art have been able to select from a variety of alternative solutions, none of which have been entirely satisfactory. For example, hermetically sealed waveguide to coaxial line adaptors have long been available at a very large cost increment over similar unsealed adaptors which are not suitable for use in pressurized systems. Alternatively, some workers have attempted to modify commercialy available unsealed adaptors by sealing those portions where leakage may occur with an epoxy type sealant. If only a small amount of such sealant is used, it may have a tendency to crack and leak following repeated environmental cycling. If an excessive amount of such an epoxy sealant is used, it can cause an electrical mismatch or high VSWR.

SUMMARY OF THE INVENTION

The present invention overcomes many of the shortcomings associated with pressurized waveguide to coaxial line connections known in the prior art. It does so by employing a novel elastomeric sealing boot which is intended for use with low cost, commercially available waveguide to coaxial line adaptors which are not intended for use in a pressurized waveguide environment. These components, when used in combination with a specially configured mounting seat on a waveguide housing, cooperate to form a novel pressure sealed waveguide to coaxial line connection.

Accordingly, an object of the present invention is to provide a pressure sealed waveguide to coaxial line connection which can overcome the shortcomings discussed above which are associated with such connections known in the prior art.

Another object of the present invention is to provide a pressure sealed waveguide to coaxial line connection of simple design which functions reliably and is economical to manufacture.

A further object of the invention is to provide a pressure sealed waveguide to coaxial line connection which includes: a housing surrounding a pressurizable cavity adapted for the propagation of selected microwave radiation, the housing possessing a flat exterior surface portion having a circular aperture into the cavity and a circular recess in the flat exterior surface portion disposed concentrically about the circular aperture; a waveguide to coaxial line adaptor which possesses an elongate probe that extends perpendicularly through a flat surface on one side of a mounting flange and a coaxial connector which is disposed on the other side of the mounting flange; a generally tubular elastomeric sealing boot with two ends, one closed and the other open and configured to receive and conformably fit about the elongate probe, the sealing boot possessing a lip which extends outwardly continuously about the open end of the boot and is configured for compressive deformation between the circular recess in the housing and an annular region on the flat surface of the mounting flange which lies in registration with the circular recess when the elongate probe and sealing boot are extended through the circular aperture into the cavity; and means attached to the housing for compressively deforming the lip and holding the flat surface on the mounting flange in parallel abutment with portions of the flat exterior surface on the housing thereby forming a pressurizable seal between the cavity and the exterior of the housing which is independent of any sealing characteristics of the adaptor.

The novel features that are considered characteristic of this invention are set forth with particularity in the appended claims.

BRIEF DESCRIPTION OF THE DRAWINGS

The many objects and advantages of the present invention will become apparent to those skilled in the art when the following description of the best mode contemplated for practicing the invention is read in conjunction with the accompanying drawings, wherein like reference characters refer to the same or similar elements and in which.

DETAILED DESCRIPTION OF THE PREFERRED EMBODIMENT

Figure 1:
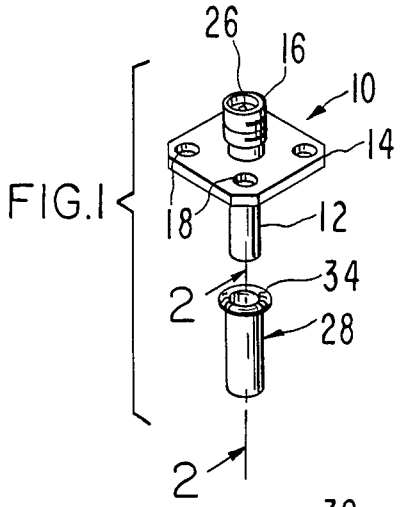
FIG. 1 is an exploded view in perspective of a waveguide to coaxial line adaptor and the elastomeric sealing boot with which it cooperates.

Referring now generally to the several figures and more specifically to FIG. 1, there is shown a waveguide to coaxial line adaptor 10 which is well-known in the prior art and suitable for use in non-pressurized waveguide systems.

The adapter 10 possesses an elongate probe 12 which extends perpendicularly from one side of a mounting flange 14. A coaxial connector 16 is disposed on the side of the flange 14 opposite the elongate probe 12. Although the coaxial connector 16 is shown with threads and extends perpendicularly away from the flange 14, those skilled in the art will appreciate that a wide variety of coaxial connector configurations, specifically including male, female, vertical and right-angle variations, would all be functionally satisfactory for use in this invention. The mounting flange 14 shown in FIGS. 1 and 3 is provided with a plurality of mounting holes 18.

Figure 3:
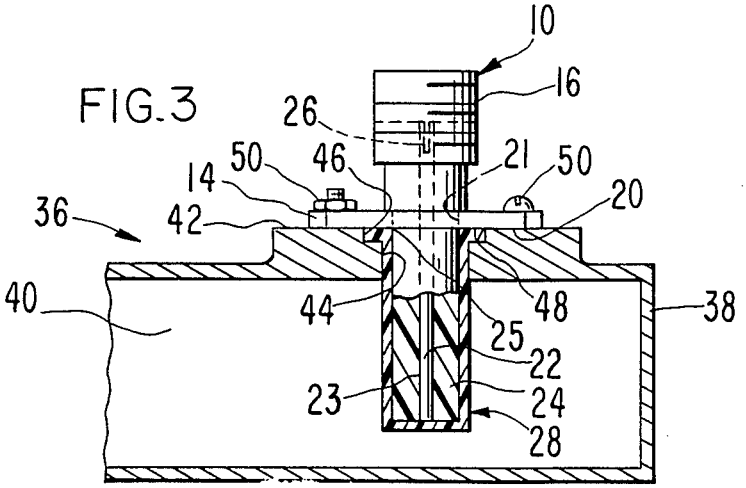
FIG. 3 is a side view in partial cross section of the pressure sealed waveguide to coaxial line connection of the invention.

FIG. 3 best illustrates a flat surface 20 on one side of the mounting flange 14. The elongate probe 12 extends perpendicularly through an aperture 21 in the flat surface 20 of the flange 14. The elongate probe 12 comprises an electrically conductive antenna element 22 which is surrounded by a dielectric impedance matching sheath 24. To assure good electrical characteristics, the antenna element 22 typically comprises gold plated copper and the matching sheath 24 typically comprises a dielectric material such as, for example, polytetrafluorethylene (PTFE). As mentioned above, the adapter 10 is of well known construction and not intended for use with pressurized waveguides. More particularly, it will be appreciated that gas leakage paths can develop at the interface 23 between the antenna element 22 and the matching sheath 24 and at the interface 25 between the exterior surface of the matching sheath 24 and the aperture 21 in the flat surface 20 of the flange 14. The coaxial connector 16 is provided with means 26 attached to the antenna element 22 for electrically connecting the antenna element 22 with the center conductor of a coaxial line (not shown).

Figure 2:
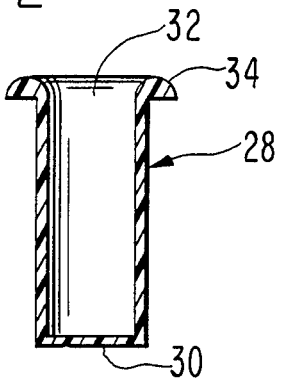
FIG. 2 is a cross sectional view through the lines 2—2 in FIG. 1 of the elastomeric sealing boot.

FIG. 2 is a cross-sectional view through the lines 2—2 in FIG. 1 of a elastomeric sealing boot 28. The sealing boot 28 is generally tubular and possesses a pair of ends 30 and 32. The end 30 is closed and the end 32 is open and configured to receive and conformably fit about the elongate probe 12 of the adapter 10. For ease of illustration, the closed end 30 is shown throughout the several figures as being generally flat and circular. However, it is to be understood that in selected applications, it may be desirable for the antenna element 22 to protrude beyond the matching sheath 24 or for the probe 12 to possess a noncircular cross-section. What is important is that the combination of the antenna element 22, the matching sheath 24, and the sealing boot 28 exhibit appropriate electrical performance characteristics as an assembly. These performance characteristics may be "fine-tuned" for a specific application, by adjusting various dimensions of the components which comprise such an assembly. The open end 32 of the sealing boot 28 possesses a lip 34 which extends outwardly and continuously about the open end 32. The lip 34 is configured for compressive deformation and sealing in a manner analogous to the way a well known O-ring seal functions. In FIG. 2, the lip 34 has been shown with a semi-circular cross-section which facilitates compression molding the sealing boot 28. Other cross-sections are, of course, possible and the selection of any specific cross-section is not functionally critical. A one-piece construction of the sealing boot 28 as shown in the drawings is preferred. A suitable elastomeric material for compression molding the sealing boot 28 is Polymer, Stock No. 1764, available from Poly Seal, Inc., 725 Channing Way, Berkeley, Calif. 94710. The principal component in this blended material is DuPont Vamac® brand of ethylene acrylic elastomer. In general, materials suitable for this application should: (a) be sufficiently resilient to enable the lip 34 to function properly as a seal when compressively deformed; (b) exhibit relatively low gas and moisture permeability; and (c) exhibit relatively low RF loss at microwave frequencies. Sealing boots 28 fabricated with molding compounds highly filled with carbon black exhibit unacceptably high RF losses. Sealing boots 28 fabricated from silicon rubber have not maintained pressurization as well as those fabricated from ethylene acrylic elastomers.

Referring now to FIG. 3, there is shown in partial cross-section a side view of the pressure sealed waveguide to coaxial line connection 36 of the invention. The connection 36 is formed between a housing 38 which is preferably electrically conductive and more preferably comprises either aluminum or copper alloy. The housing 38 contains a pressurizable cavity 40 which is adapted for the propagation of selected microwave radiation. The housing 38 possesses a flat exterior surface portion 42 having a circular aperture 44 therein which opens into the pressurizable cavity 40. A circular recess 46 is disposed concentrically about the aperture 44 in the flat exterior surface portion 42.

To form the connection 36, the elongate probe 12 of the adapter 10 is inserted into the open end 32 of the sealing boot 28 which in turn is deployed through the aperture 44 in the housing 38 as shown. The lip 34 is configured for seating in the circular recess 46. An annular region 48 on the flat surface 20 on the mounting flange 14 lies in registration with the circular recess 46 and portions thereof contact portions of the lip 34.

Means 50 are attached to the housing 38 for compressively deforming the lip 34 between the circular recess 46 and the annular region 48 and holding the flat surface 20 on one side of the mounting flange 14 in parallel abutment with portions of the flat exterior surface portion 42 of the housing 38. The means 50 shown in FIG. 3 comprise threaded fasteners which extend through the mounting holes 18 in the mounting flange 14 into a raised boss portion of the housing 38. Although the means 50 which are suggested in FIG. 3 are preferred, it is to be understood that other conventional arrangements may be employed to compressively deform the lip 34 and hold the mounting flange 14 in abutment with the housing 38. Examples of such alternative and obvious means include: threaded fasteners which do not extend through the mounting holes 18, but engage peripheral edge portions of the mounting flange 14; straps which extend about portions of the housing 38 and extend around portions of the mounting flange 14; and epoxy type adhesives which are applied and allowed to cure with the mounting flange 14 temporarily clamped in the desired position of abutment with the flat exterior surface portion 42. The pressure sealed waveguide to coaxial line connection 36 of the invention forms a pressurizable seal between the cavity 40 and the exterior of the housing 38 which is independent of any sealing characteristics of the adapter 10. More particularly, the compressed lip 34 functions to prevent pressure loss from the cavity 40 through the interface formed between the flat surface 20 on one side of the mounting flange 14 and the flat exterior surface portion 42 of the housing 38. The sealing boot 28 functions to prevent leakage at the interface 23 between the antenna element 22 and the matching sheath 24 and at the interface 25 between the exterior surface of the matching sheath 24 and the aperture 21 in the flat surface 20 of the flange 14.

From the foregoing detailed description, it will be evident that there are a number of changes, adaptations and modifications of the present invention which come within the province of those skilled in the art; however, it is intended that all such variations not departing from the spirit of the invention be considered as within the scope thereof as limited solely by the appended claims.

What is claimed is:

1. A pressure sealed waveguide to coaxial line connection comprising:

a housing surrounding a pressurizable cavity adapted for the propagation of selected microwave radiation which possesses a flat exterior surface portion having a circular aperture therein which opens into said cavity;

a circular recess in said flat exterior surface portion disposed concentrically about said circular aperture;

a waveguide to coaxial line adaptor which possesses an elongate probe that extends perpendicularly through a flat surface on one side of a mounting flange and a coaxial connector which is disposed on the other side of said mounting flange;

a generally tubular elastomeric sealing boot with two ends, one closed and the other open and configured to receive and conformably fit about said elongate probe of said adaptor, said sealing boot possessing a lip which extends outwardly continuously about said open end and is configured for compressive deformation between said circular recess in said housing and an annular region of said flat surface on said mounting flange which lies in registration with said circular recess when portions of said elongate probe and said sealing member are extended through said circular aperture into said cavity; and means attached to said housing for compressively deforming said lip and holding said flat surface on said mounting flange in parallel abutment with portions of said flat exterior surface portion on said housing thereby forming a pressurizable seal between said cavity and the exterior of said housing which is independent of any sealing characteristics of said adaptor.

2. A pressure sealed waveguide to coaxial line connection according to claim 1 wherein said means attached to said housing for compressively deforming said lip and holding said flat surface on said mounting flange in parallel abutment with portions of said flat exterior surface portion on said housing comprise a plurality of threaded fasteners which extend through a corresponding plurality of mounting holes in said mounting flange.

3. A pressure sealed waveguide to coaxial line connection according to claim 1 wherein said generally tubular elastomeric sealing boot is fabricated from a material that comprises ethylene acrylic elastomer.

* * * * *